US008604702B2

(12) United States Patent
Bertram

(10) Patent No.: US 8,604,702 B2
(45) Date of Patent: Dec. 10, 2013

(54) METHOD AND APPARATUS FOR SETTING A CHROMATICITY COORDINATE

(75) Inventor: Ralph Bertram, Nittendorf (DE)

(73) Assignee: OSRAM GmbH, Munich (DE)

( * ) Notice: Subject to any disclaimer, the term of this patent is extended or adjusted under 35 U.S.C. 154(b) by 113 days.

(21) Appl. No.: 13/321,819

(22) PCT Filed: May 11, 2010

(86) PCT No.: PCT/EP2010/056478

§ 371 (c)(1),
(2), (4) Date: Nov. 21, 2011

(87) PCT Pub. No.: WO2010/133481

PCT Pub. Date: Nov. 25, 2010

(65) Prior Publication Data

US 2012/0068610 A1 Mar. 22, 2012

(30) Foreign Application Priority Data

May 19, 2009 (DE) ..... 10 2009 021 845
Sep. 23, 2009 (DE) ..... 10 2009 048 871

(51) Int. Cl.
*H05B 37/02* (2006.01)

(52) U.S. Cl.
USPC ..... 315/152; 315/297

(58) Field of Classification Search
None
See application file for complete search history.

(56) References Cited

U.S. PATENT DOCUMENTS

2003/0057884 A1* 3/2003 Dowling et al. ..... 315/291
2005/0200295 A1* 9/2005 Lim et al. ..... 315/150

FOREIGN PATENT DOCUMENTS

EP 1 662 583 5/2006
WO WO 2008/139369 11/2008
WO WO 2009/039132 3/2009

* cited by examiner

*Primary Examiner* — Crystal L Hammond
(74) *Attorney, Agent, or Firm* — Cozen O'Connor

(57) ABSTRACT

A method for setting a color locus of a luminaire (110) comprising at least one phosphor-converted light-emitting diode (103, 105) and at least one monochromatic light-emitting diode (104), wherein the method comprises the steps of: setting a current for the at least one phosphor-converted light-emitting diode (103, 105) setting a pulse width modulation for the at least one phosphor-converted light-emitting diode (104); and setting a current or a pulse width modulation for the at least one monochromatic light-emitting diode (104).

19 Claims, 4 Drawing Sheets

METHOD AND APPARATUS FOR SETTING A CHROMATICITY COORDINATE

RELATED APPLICATIONS

This is a U.S. National Stage of International Application No. PCT/EP2010/056478, filed on May 11, 2010, and claims priority on German patent application No. 10 2009 021 845.9, filed on May 19, 2009 and German patent application No. 10 2009 048 871.5, filed on Sep. 23, 2009, the entire content of both of which are hereby incorporated by reference.

FIELD OF THE INVENTION

The invention relates to a method and an apparatus for setting a color locus. Furthermore, the invention proposes a lamp or luminaire comprising such an apparatus.

BACKGROUND OF THE INVENTION

For luminaires, it is advantageous if light can be generated efficiently which has a color locus on or near the Planckian curve, preferably with a color temperature of between 2000K and 4000K or at a standard color locus pursuant to IEC 60081. In particular, light-emitting diodes (LEDs) can be used for this purpose. One aim consists in achieving a high level of color rendering or color fidelity which is virtually constant within wide ranges.

In particular, phosphor-converted light-emitting diodes can be used in a specified range in the Cx-Cy chromaticity diagram above the Planckian curve. In order to achieve a color locus on the Planckian curve, in addition red light-emitting diodes can be used. This makes it possible to achieve a high color rendering index Ra(8)>90.

Luminaires in accordance with the prior art are associated with the problem that brightnesses and color loci of the light-emitting diodes used drift with a change in temperature. The individual light-emitting diodes are also subject to ageing, with the result that over the course of time the color impression imparted by the luminaire changes. A temperature range of from 20° C. (for example when the luminaire is switched on) to 100° C. in a thermally settled state is conventional for the luminaire.

A luminaire is known which has red light-emitting diodes and in which the brightness of the red light-emitting diodes is measured by means of a sensor. The current through the light-emitting diodes or a pulse with modulation (PWM) is adjusted in such a way that the overall color locus of the luminaire is approximately constant.

One disadvantage here is the fact that the color locus changes as the temperature increases (typically by +0.07 nm/K) owing to the shift in the dominant wavelength of the red LEDs. This results in a shift in the overall color locus by approximately three MacAdam threshold value units (TVU) with respect to the original color locus. To this extent, the change in the color locus as the temperature changes can also be perceived by a user.

SUMMARY OF THE INVENTION

One object of the invention is to avoid the above-mentioned disadvantages and in particular, to provide an efficient possible way of keeping the color locus of a luminaire (largely) constant.

One aspect of the invention is directed to a method for setting a color locus of a luminaire comprising at least one phosphor-converted light-emitting diode and at least one monochromatic light-emitting diode, in which a current for the at least one phosphor-converted light-emitting diode is set;

in which a pulse width modulation for the at least one phosphor-converted light-emitting diode is set;

in which a current or a pulse width modulation for the at least one monochromatic light-emitting diode is set.

The light-emitting diode may be any desired semiconductor light-emitting element in each case.

Therefore, the number of LED colors used corresponds to the number of lighting engineering parameters intended to be regulated and/or controlled, for example a brightness, CIE coordinates (Cx, Cy) or tristimulus coordinates (X, Y, Z) minus one. Therefore, the regulation and/or control is not performed merely via the brightnesses of the individual colors. Advantageously the control and/or regulation is therefore performed via the mentioned combination of current and pulse width modulation of the individual types of light-emitting diodes.

In this case, setting the pulse width modulation means in particular that the duty factor (active/inactive) can be set per time interval for driving the respective LED. For example, a 50% pulse width modulation means that the light-emitting diode is switched so as to be active 50% of the time and inactive 50% of the time within a predetermined time interval.

The phosphor-converted LED has, for example, a wavelength-converting phosphor, for example on the basis of garnets such as YAG:Ce. Such an LED can emit, for example, yellowish, greenish, blue-greenish or reddish light.

One development is that the color locus is set depending on a setpoint color locus, in particular depending on a threshold value around the setpoint color locus.

Therefore, when the threshold value around the setpoint color locus is reached, a correction of the color locus can be initiated. The threshold value can be selected such that the human eye (virtually) does not yet perceive a change in the color locus up to this threshold value.

Another development is that an actual value is identified by means of at least one sensor, wherein a discrepancy between the actual value and the setpoint color locus is determined and the color locus is set correspondingly in such a way that the setpoint color locus is achieved.

In this case, the setpoint color locus can be set precisely or with a predetermined degree of unsharpness. For example, it is possible to determine the setpoint color locus within a MacAdam ellipse using a predetermined number of MacAdam threshold value units.

A particular development is one in which the at least one sensor comprises a temperature sensor and/or an optical sensor.

A further development is that the actual value is determined in accordance with a CIE CxCy color space, in accordance with a CIE uv color space, in accordance with a CIE u'v' color space and/or in accordance with a tristimulus XYZ space.

In particular, any desired color spaces can be provided.

An additional development is one in which the actual value is converted into the following regulation parameters for setting the color locus:

the current for the at least one phosphor-converted light-emitting diode;

the pulse width modulation for the at least one phosphor-converted light-emitting diode;

the current for the at least one monochromatic light-emitting diode.

It is also possible for the actual value to be converted into the following regulation parameters for setting the color locus:

- the current for the at least one phosphor-converted light-emitting diode;
- the pulse width modulation for the at least one phosphor-converted light-emitting diode;
- the pulse width modulation for the at least one monochromatic light-emitting diode.

Therefore, the color space of the actual value is converted into a target color space which is identified using the described regulation parameters.

In the context of an additional development, the color locus is set by means of a lookup table.

Therefore, the determination of the regulation parameters of the target color space can be calculated or the actual values can be used, without any special calculation or transformation, to determine the regulation parameters from a structure of prestored values.

A further development consists in that the phosphor-converted light-emitting diode emits light in at least one of the following colors:

- white light,
- violet light,
- greenish light,
- reddish light.

One configuration consists in that the monochromatic light-emitting diode is a red light-emitting diode.

The abovementioned object is also achieved by an apparatus for setting a color locus of a lamp or luminaire comprising at least one phosphor-converted light-emitting diode and at least one monochromatic light-emitting diode,

- with a control unit, which detects a brightness and/or a temperature of the light-emitting diodes via at least one sensor and drives a driver in such a way that
  - a current can be set for the at least one phosphor-converted light-emitting diode;
  - a pulse width modulation can be set for the at least one phosphor-converted light-emitting diode;
  - a current or a pulse width modulation can be set for the at least one monochromatic light-emitting diode.

A development consists in that the control unit comprises a microcontroller or a processor.

The above object is also achieved using a luminaire comprising the apparatus as described herein.

BRIEF DESCRIPTION OF THE DRAWINGS

Exemplary embodiments of the invention will be illustrated and explained below with reference to the drawings, in which.

DETAILED DESCRIPTION OF THE DRAWINGS

The approach proposed here makes it possible to set a (virtually) constant color locus and to (largely) maintain said color locus in a lamp or luminaire comprising a plurality of light-emitting diodes.

The observation is made here that a light-emitting diode can also comprise any semiconductor light-emitting element whatsoever.

The proposed luminaire comprises at least one monochromatic LED (for example with the color red or a reddish coloration) as well as at least one "white" LED. The "white" LED is a phosphor-converted LED. The observation is made here that the phosphor-converted LED is not restricted to the emission of "white" light. Instead, there are also phosphors which permit the emission of violet, greenish or else reddish light, for example.

The invention proposes the following possibilities for regulation and/or control:

(a) PWM of the monochromatic LED (red) and current regulation of the white LED and PWM of the white LED;

(b) current regulation of the monochromatic LED (red) and current regulation of the white LED and PWM of the white LED.

Therefore, current regulation and PWM are performed for the phosphor-converted LED (also referred to here as "white" LED), while current regulation or PWM is performed for the monochromatic LED.

Use is therefore made of the fact that the color locus of the phosphor-converted LED shifts with the current, but not with PWM regulation.

Therefore, in the abovementioned approaches (a) and (b) there are in each case three independent controlled or regulated variables which bring about linearly independent changes within a (three-dimensional) color space. The color locus and brightness can thus be controlled or regulated (within measurement and regulation tolerances).

The brightness and color locus of the luminaire can be adjusted by means of the three controlled or regulated variables without the need to provide any additional LEDs or without the need for any additional regulation complexity.

Figure 1:
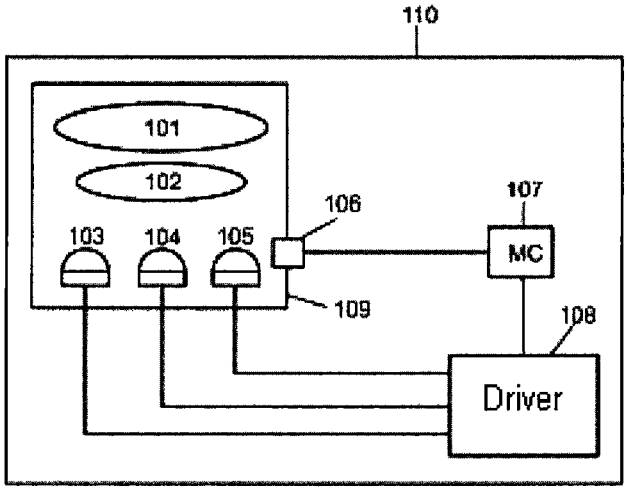
FIG. 1 shows a schematic illustration of an apparatus for a luminaire with two phosphor-converted LEDs and a monochromatic LED.

FIG. 1 shows a schematic illustration of an apparatus for a luminaire 110.

The luminaire 110 comprises a light-emitting element 109 with a possibly multi-stage mixed optical unit 101, 102, a red LED 104 and two white LEDs 103, 105. A sensor 106 is arranged at the light-emitting element 109. The sensor 106 may be an optical sensor and/or a temperature sensor. The sensor 106 is connected to a microcontroller 107, which drives an LED driver 108 depending on the signal detected by means of the sensor 106. The LEDs 103 to 105 are each connected to the LED driver 108.

The LED driver 108 comprises a current source for the red LED 104 with current regulation or with PWM regulation. Furthermore, the LED driver 108 comprises a current source for the white LEDs 103, 105 with current regulation and PWM regulation.

Mention is made here of the fact that a plurality of (also different) sensors can be provided at different locations in the luminaire 110 and/or outside the luminaire 110.

The regulation of the color locus of the luminaire 110 can be performed, for example, by means of correcting the values detected via the sensor 106. This correction comprises a transformation of the discrepancy vectors (Cx, Cy, brightness) into a coordinate system of the change vectors of the regulation parameters (PWM red, current white and PWM white). The microcontroller 107 regulates the overall color locus and the brightness to the setpoint value, for example via PID regulation in each regulation parameter. The discrepancy of the setpoint value can be markedly below 1 TVU, for example, and can therefore be kept invisible to the human eye.

Figure 2:
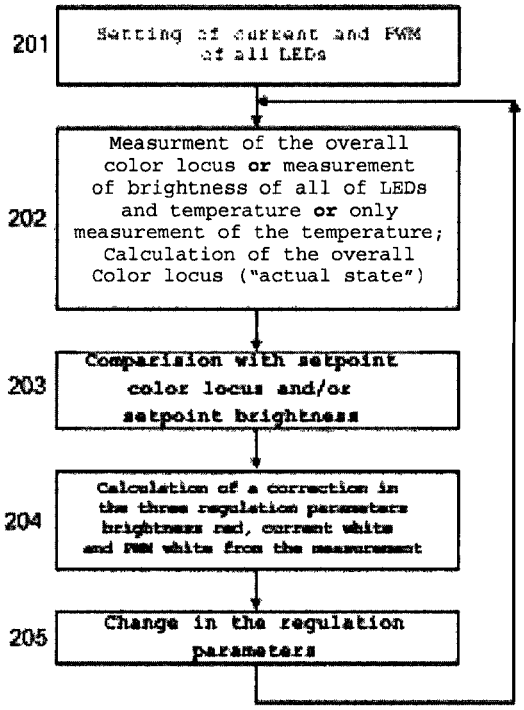
FIG. 2 shows a schematic flowchart with steps for setting the color locus of the luminaire.

FIG. 2 shows a schematic flowchart with steps for setting the color locus of the luminaire.

In a step 201, a predetermined current or PWM value is applied to the light-emitting diodes. This is used for presetting prior to the beginning of the actual regulation.

In a step 202, the overall color locus of the luminaire, or the brightnesses of the LEDs and the temperature or only the temperature is/are measured. The overall color locus corresponds to an actual state. In the two last-mentioned options, the overall color locus is calculated using the measured brightnesses or the determined temperature.

In a subsequent step 203, the actual state is compared with a setpoint color locus and/or a setpoint brightness. In a step 204, a correction in the direction of the setpoint values (setpoint color locus and/or setpoint brightness) is determined. For this purpose, regulation parameters brightness (current and PWM value) of the red LED, current for the white LEDs, PWM value for the white LEDs are calculated.

Finally, in a step 205, the regulation parameters are changed and therefore a change in the color locus of the luminaire is corrected.

This regulation can be performed automatically at specific times (for example iteratively every n minutes). It is also possible for the regulation to be started above a certain degree of change; it is thus possible, for example, for a change established by the sensor to be the cause of the regulation. For this purpose, a threshold value comparison can be used, and the regulation can be started, for example, when the threshold value is reached or exceeded.

Figure 3A:
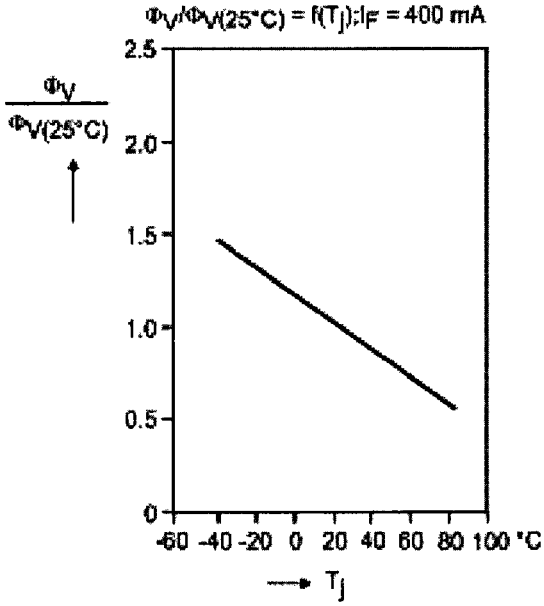
FIG. 3A shows a graph for visualizing a relative luminous flux as a function of the temperature for a red LED.
Figure 3B:
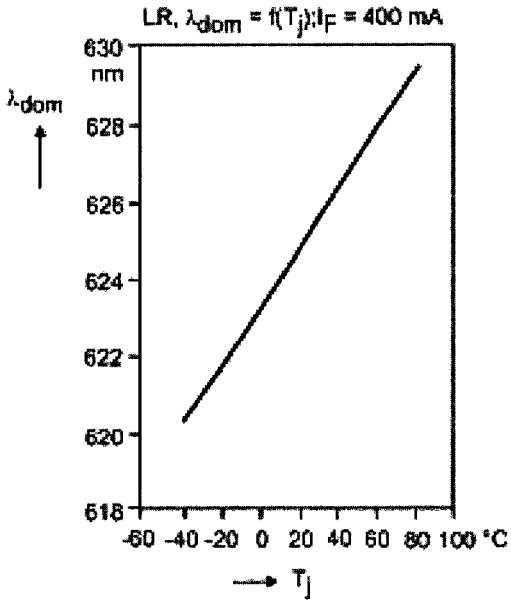
FIG. 3B shows a graph for visualizing a change in the dominant wavelength over the temperature for a red LED.

FIG. 3A shows a relative luminous flux $\phi_v/\phi_{v(25^\circ\ C.)}$ as a function of the temperature for a red LED. FIG. 3B shows the change in a dominant wavelength λ over the temperature for the red LED.

It is demonstrated that the red LED firstly loses brightness as the temperature increases, as a rough approximation:

$$\frac{d\Phi_V}{dT} = \Phi_{V(23^\circ C.)} \cdot (-0.66\%/K).$$

At the same time, the dominant wavelength λ changes with the temperature as follows:

$$\frac{d\lambda}{dT} = +0.07\ \text{nm}/K.$$

In CIE 1931 coordinates, this corresponds to approximately $$\frac{dCx}{dT} = 1.390 \cdot 10^{-4}/K \text{ and}$$

$$\frac{dCy}{dT} = -1.384 \cdot 10^{-4}/K.$$

The brightness of the red LED can be set via the duty factor of a PWM. Alternatively, the current through the red LED can be increased, which brings about a nonlinear change in the luminous flux with the current. In both cases (change in the current through the red LED or change in the PWM value), there is no substantial change in the dominant wavelength and therefore the color locus of the red LED.

By way of example, it can be assumed below that there is PWM regulation of the brightness, i.e.

$$\frac{d\Phi_V}{dPWM} = \Phi_V(PWM = 100\%).$$

Figure 4A:
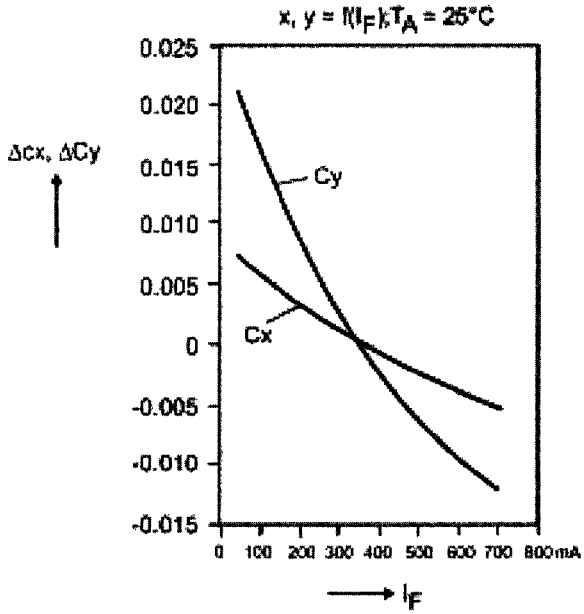
FIG. 4A shows a graph with a color locus shift depending on a current through a white LED.
Figure 4B:
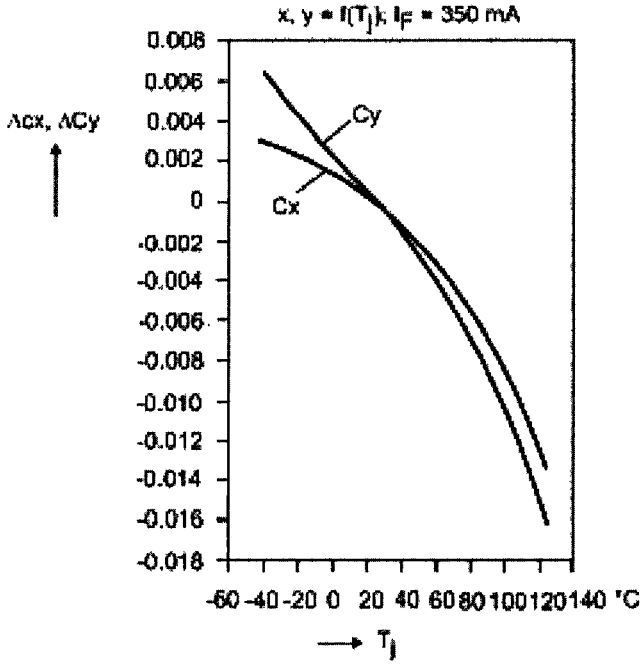
FIG. 4B shows a graph with a color locus shift depending on the temperature for a white LED.

White LEDs likewise demonstrate changes in brightness and color locus (see FIG. 4A and FIG. 4B).

FIG. 4A gives the following for the shift in the color locus of the white LED in a temperature range of 20° C. to 100° C. in approximation:

$$\Phi_V = \Phi_{V(23^\circ C.)} \cdot (-0.2\%/K) \cdot T;$$

$$\frac{dCx}{dT} = \frac{dCy}{dT} = -1.25 \cdot 10^{-5}/K.$$

For ultra-white LEDs, a shift of).

$\Delta Cx$=0.0015 per 100 mA $\Delta Cy$=0.00375 per 100 mA is applicable, for example, as an approximation.

Corresponding to the red LED, the following is also true for the white LED:

$$\frac{d\Phi_V}{dPWM} = \Phi_V(PWM = 100\%)$$

Used white LEDs can change their brightness with the current approximately as follows:

$$\frac{d\Phi_V}{dI} = \Phi_{V0} \cdot a \cdot \frac{1}{I + Is},$$

where a=1.53 and $I_S$=0.38 A.

The color space can be described, for example, with coordinates pursuant to CIE 1931 as Φv-Cx-Cy. Alternatively, the tristimulus (X, Y, Z) space can be used.

Preferably, the regulation is such that the change vectors of the overall color locus $$\sum_i \frac{dCx_i}{dT}, \sum_i \frac{dCy_i}{dT}, \sum_i \frac{d\Phi_{Vi}}{dT}$$

are canceled out or approximately canceled out by change vectors $$\left(\sum_i \frac{dCx_i}{dPWM_i}\right) + \frac{dCx_{white}}{dI_{white}};$$

$$\left(\sum_i \frac{dCy_i}{dPWM_i}\right) + \frac{dCy_{white}}{dI_{white}};$$

$$\left(\sum_i \frac{d\Phi_{Vi}}{dPWM_i}\right) + \frac{d\Phi_{V\,white}}{dI_{white}}$$

Alternatively, this correction can also be realized via a controller with the aid of a lookup table.

Figure 5:
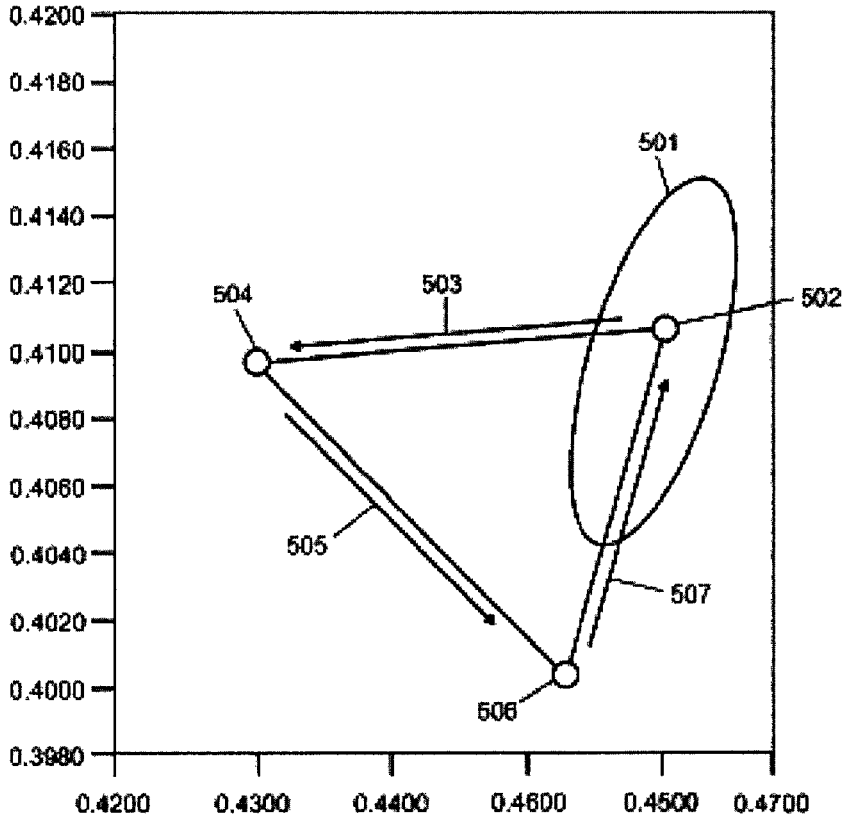
FIG. 5 shows a graph with a setpoint color locus which is approximately in the center of an ellipse, with steps for regulation with respect to this setpoint color locus being explained.

FIG. 5 shows a graph with a setpoint color locus 502, which is approximately in the center of an ellipse 501. The ellipse 501 corresponds, by way of example, to a color temperature of 2700K; the color temperature lies on the Planckian curve and has a diameter of 3 TVU. Changes within this ellipse 501 are not perceived (or are not perceived as disruptive) to the untrained human eye.

The light-emitting diodes (according to the example in FIG. 1: two white LEDs and one red LED) are driven as follows:

white LEDs: $I_{max}$=700 mA; 60% PWM;

red LED: 350 mA constant.

In the event of an increase in the temperature without a correction $$\frac{d\lambda_{red}}{dT}; \frac{d\Phi_{Vi}}{dT}$$

the color locus of the luminaire shifts in the direction of an arrow 503 to a color locus 504.

The brightness of the red LED can now be increased to 145% (corresponding to a current increase of approximately 170% to approximately 600 mA), and a correction $$\frac{d\Phi_{V\,red}}{dPWM_{red}}$$

in the direction of an arrow 505 to a color locus 506 is performed.

A correction $$\frac{dCx_{white}}{dI_{white}}, \frac{dCy_{white}}{dI_{white}},$$

is now performed by virtue of the current of the white LEDs being reduced to 350 mA and the PWM for the white LEDs being raised to 100%. As a result, the color locus drifts in the direction of an arrow 507 to the setpoint color locus 502.

The invention claimed is:

1. A method for setting a color locus of a luminaire comprising at least one phosphor-converted light-emitting diode and at least one monochromatic light-emitting diode, wherein the method comprises the steps of:

setting a current for the at least one phosphor-converted light-emitting diode;

setting a pulse width modulation for the at least one phosphor-converted light-emitting diode; and setting a current or a pulse width modulation for the at least one monochromatic light-emitting diode.

2. The method of claim 1, wherein the color locus is set depending on a setpoint color locus.

3. The method of claim 2, further comprising:

measuring an actual value of a color locus of the luminaire by at least one sensor;

determining a difference between the actual value and the setpoint color locus; and adjusting the pulse width modulation for the at least one phosphor-converted light-emitting diode and the current or a pulse width modulation for the at least one monochromatic light-emitting diode based upon the difference determined so that the setpoint color locus is achieved.

4. The method of claim 3, wherein the at least one sensor comprises an optical sensor.

5. The method of claim 3, wherein the actual value is determined in accordance with a CIE CxCy color space, in accordance with a CIE uv color space, in accordance with a CIE u'v' color space and/or in accordance with a tristimulus XYZ space.

6. The method of claim 3, wherein the actual value is converted into the following regulation parameters for setting the color locus:

the current for the at least one phosphor-converted light-emitting diode;

the pulse width modulation for the at least one phosphor-converted light-emitting diode; and the current for the at least one monochromatic light-emitting diode.

7. The method of claim 3, wherein the actual value is converted into the following regulation parameters for setting the color locus:

the current for the at least one phosphor-converted light-emitting diode;

the pulse width modulation for the at least one phosphor-converted light-emitting diode; and the pulse width modulation for the at least one monochromatic light-emitting diode.

8. The method of claim 3, wherein the at least one sensor comprises a temperature sensor.

9. The method of claim 1, wherein the color locus is set by a lookup table.

10. The method of claim 1, wherein the phosphor-converted light-emitting diode emits light in at least one of the following colors:

white light, violet light, greenish light, and reddish light.

11. The method of claim 1, wherein the monochromatic light-emitting diode is a red light-emitting diode.

12. The method of claim 1, wherein the color locus is set depending on a threshold value around the setpoint color locus.

13. The method of claim 1, wherein the at least one monochromatic light-emitting diode is set with pulse width modulation.

14. An apparatus for setting a color locus of a lamp or luminaire comprising:

at least one phosphor-converted light-emitting diode;

at least one monochromatic light-emitting diode;

a control unit, which detects a brightness and/or a temperature of the light-emitting diodes via at least one sensor and drives a driver in such a way that:

a current can be set for the at least one phosphor-converted light-emitting diode;

a pulse width modulation can be set for the at least one phosphor-converted light-emitting diode; and a current or a pulse width modulation can be set for the at least one monochromatic light-emitting diode.

15. The apparatus of claim 14, wherein the control unit comprises a microcontroller or a processor.

16. A lamp or luminaire comprising the apparatus of claim 14.

17. The apparatus of claim 14, wherein the sensor detects a brightness of the light-emitting diodes.

18. The apparatus of claim 14, wherein the sensor detects a temperature of the light-emitting diodes.

19. The apparatus of claim 14, wherein the at least one monochromatic light-emitting diode is set with pulse width modulation.

* * * * *